United States Patent [19]

Leichter et al.

[11] 4,357,405

[45] Nov. 2, 1982

[54] FLUORINATED DYE SENSITIZED ORGANIC ELECTRON DONOR COMPOUND

[75] Inventors: Louis M. Leichter, Woodbury; John J. Stofko, Jr., St. Paul; Terry J. Sonnonstine, White Bear Lake, all of Minn.

[73] Assignee: Minnesota Mining and Manufacturing Company, St. Paul, Minn.

[21] Appl. No.: 237,067

[22] Filed: Feb. 23, 1981

[51] Int. Cl.[3] ..... G03G 5/04

[52] U.S. Cl. ..... 430/58; 430/59; 430/82; 430/83; 430/900; 430/512

[58] Field of Search ..... 430/82, 83, 59, 900, 430/570, 512, 591, 58

[56] References Cited

U.S. PATENT DOCUMENTS

| | | | |
|---|---|---|---|
| 3,933,914 | 1/1976 | Coles et al. | 260/577 |
| 4,018,810 | 4/1977 | Skoog | 260/465 D |

*Primary Examiner*—John D. Welsh

*Attorney, Agent, or Firm*—Cruzan Alexander; Donald M. Sell; Mark A. Litman

[57] ABSTRACT

Organic electron donor compounds for use in electrophotographic constructions must ordinarily be sensitized to desired regions of the electromagnetic spectrum. Highly fluorinated aliphatic sulfonyl, carbonyl, or carbonyloxy dyes have been found to be efficient sensitizers for such organic donor compounds.

15 Claims, No Drawings

FLUORINATED DYE SENSITIZED ORGANIC ELECTRON DONOR COMPOUND

TECHNICAL FIELD

The present invention relates to novel photoconductive systems and layers which comprise novel electron donor compounds and highly fluorinated aliphatic sulfonyl sensitizer dyes. These layers are particularly useful in imaging systems such as electrophotography or electroradiography.

BACKGROUND OF THE ART

The technology of electrophotography is commercially well established. A wide variety of processes and apparatus are used, although they have many characteristics in common. One of the more common forms of this technology involves the use of a plate having a photoconductive insulating layer, generally coated on a conductive layer. Imaging is effected by first uniformly electrostatically charging the surface of the photoconductive layer and then exposing the charged layer to an image or pattern of activating electromagnetic radiation, usually visible light or ultraviolet radiation. This exposure selectively enables the charge in the irradiated areas of the photoconductive insulator to dissipate. The charge which remains in the non-irradiated areas forms a latent image which may be further processed to form a more permanent record of the exposing image or pattern. The most common form of additional processing involves the attraction of particles of material selectively to the charged areas and fusing them to the photoconductive layer or transferring the particles in their imagewise distribution to another surface to which they are more permanently bound by an adhesive or by fusion of the particles themselves. A common electrophotographic construction comprises, in sequence, a substrate, a conductive layer, and a photoconductive insulating layer.

Typical classes of photoconductive materials useful in electrophotography include (1) inorganic crystalline photoconductors such as cadmium, sulfide, cadmium sulfoselenide, cadmium selenide, zinc sulfide, zinc oxide, and mixtures thereof, (2) inorganic photoconductive glasses such as amorphous selenium, selenium alloys, and selenium-arsenic, and (3) organic photoconductors such as phthalocyanine pigments and polyvinyl carbazole, with or without binders and additives which extend their range of spectral sensitivity. These systems are well known in the art. For example, U.S. Pat. No. 3,877,935 discusses various problems associated with the crystalline and amorphous classes of photoconductors and shows the use of polynuclear quinone pigments in a binder as a photoconductive layer. U.S. Pat. No. 3,824,099 shows the use of squaric acid methine and triaryl pyrazoline compounds as an electrophotographic charge transport layer. Cadmium sulfoselenide plates are shown in U.S. Pat. No. 3,764,315, and one of the original disclosures of the use of poly-N-vinylcarbazole as a photoconductive insulating layer is provided in U.S. Pat. No. 3,037,861. A number of diverse organic photoconductors have been disclosed since the development of the carbazole class of photoconductors such as quinones and anthrones (e.g., Hayashi et al., *Bull. Chem. Soc. Japan,* vol. 39, (1966) pp. 1670–1673), but the carbazoles have continued to attract the greatest attention. These problems are discussed in U.S. Pat. No. 3,877,935.

Other problems, particularly associated with the use of carbazoles as a positive charge transporting material which is capable of supporting the injection of photoexcited holes from a photoconductive layer and is capable of transporting the injected holes also exist in this area of technology. The carbazole condensates with aldehydes as shown in U.S. Pat. No. 4,025,341 have a tendency to oligomerize. This oligomerization can cause a number of problems. The oligomers formed are not of a uniform molecular weight and carbazole content. This creates problems in purification and can create undesirable variations in photoconductive or charge transport properties. Triaryl methanes including a carbazole moiety (as shown in Xerox Disclosure Journal, Vol. 3, No. 1, Jan./Feb. 1978, page 7) also tend to be sensitive to oxidation which converts them to an ionic species which will not act as a photoconductive insulator.

Japanese Patent Publication No. 52-34735 discloses carbazole organic photoconductor materials which may have substituents thereon which would inherently prevent oligomerization of the carbazoles. This is not recognized in the disclosure and the carbazoles would still be subject to oxidation problems.

SUMMARY OF THE INVENTION

Electronically active organic donor compounds have been found to be sensitized by a defined class of fluorinated alkylsulfonyl, alkylcarbonyl, and alkylcarbonyloxy dyes.

A novel class of electronically active organic electron donor compounds which may be sensitized according to the present invention are represented by the formula:

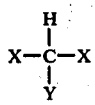

where X is

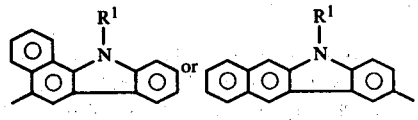

wherein R is an aliphatic, aromatic, or mixed aliphatic-aromatic group and Y is an aliphatic, aromatic, heterocyclic, or mixed aliphatic-aromatic group. For example, R and Y may be independently selected from alkyl groups, benzyl groups, phenyl groups, naphthyl groups, anthracyl groups, etc., with such various substituents as alkoxy groups, amine groups, alkyl groups, hydroxyl groups, and halogen atoms thereon.

These compounds have been found to be electron donor compounds and are useful in forming photoconductive layers when sensitized with disulfone systems and dyes. They may be combined with polymeric binder materials to form photoconductive layers which are solid state molecular solution charge transport layers. The electron donor compounds have a reduced sensitivity to oxygen and oligomerization.

DETAILED DESCRIPTION OF THE INVENTION

All electronically active organic donor compounds, as they are known in the art, may be sensitized to various portions of the electromagnetic spectrum by (fluorinated alkyl)sulfonyl dyes, (fluorinated alkyl) carbonyl dyes, and (fluorinated alkyl)carbonyloxy dyes. Typical electronically active organic donor compounds are poly-N-vinyl carbazole, polyanthracene, polyvinylacenaphthalene, poly-2,6-methylene fluorene, polyvinyl ferrocene, polybenzocarbazole, polybenzoanthracene, and the like.

Novel electronically active organic donor compounds useful in the present invention are bis(benzocarbazoles) may be represented by the formula

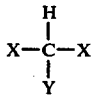

where X is

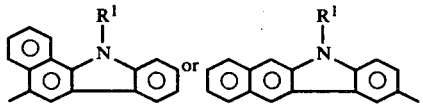

wherein $R^1$ is an aliphatic, aromatic or mixed aliphatic-aromatic group and

Y is an aliphatic, aromatic, heterocyclic, or mixed aliphatic-aromatic group.

All of these compounds may be synthesized by reacting the appropriate N-substituted benzo[a]carbazole or benzo[b]carbazole:

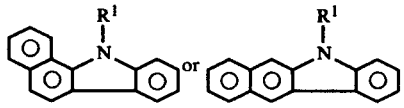

with the correspondingly appropriate aldehyde:

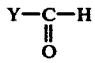

This process can be carried out in a solvent (e.g., ethanol) in the presence of an acid (e.g., HCl) catalyst. The reaction product may be isolated by simple filtration and washing. For example, in the reaction of N-ethylbenzo[a]carbazole with benzaldehyde in ethanol in the presence of HCl as a catalyst, the preferential reaction of the aldehyde at the 5-position of the N-benzo[a]carbazole and the insolubility of the reaction product:

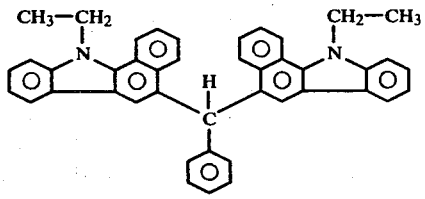

in ethanol, no oligomeric species are formed such as occur in a similar reaction with N-ethyl-carbazole. The reaction product is also stabilized against oxidation of the methine group by the rings ortho to point at which the methine group is bonded to the benzocarbazole nucleus.

$R^1$ may, as previously stated, be selected from aliphatic, aromatic and mixed aliphatic-aromatic groups. These groups may or may not be substituted. If they are substituted, it would be preferred that they be electron donating substituents although electron withdrawing substituents may be tolerated. Preferably $R^1$ is selected from alkyl groups of 1 to 20 carbon atoms, preferably n-alkyl groups of 2 to 20 carbon atoms, aryl groups such as phenyl or naphthyl groups, with phenyl groups preferred, alkaryl groups, for example benzyl groups, and allyl groups. Where the term 'group' is used anywhere in the practice of the present invention, as opposed to the term 'radical,' the possibility of substitution is specifically intended to be included within the definition of that term. For example, n-alkyl radical may be only of the formula $-(CH_2)_n-CH_3$ while n-alkyl group may have hydrogen atoms on the n-alkyl radical substituted with other moieties such as halogen atoms, hydroxyl radicals, alkoxy radicals, alkyl radicals, amine radicals, cyano radicals, etc. Specific examples of useful $R^1$ moieties are ethyl, n-butyl, n-propyl, 4-methoxybutyl, 3-chloropropyl, 8-hydroxyoctyl, phenyl, benzyl, allyl, p-ethylphenyl, m-tert-butylnaphthyl, p-diethylaminophenyl, stearyl, dodecyl, etc. $R^1$ preferably has fewer than 20 carbon atoms, but may have up to 30 or more carbon atoms. The main influence of this group, except where electronic induction occurs because of a change of the nature of this group, is in the solubility of the compound.

Y may, as previously stated, be selected from aliphatic, aromatic, and mixed aliphatic-aromatic groups. These groups may or may not be substituted. Examples of useful moieties are methyl, ethyl, n-pentyl, nonyl, stearyl, tolyl, anisyl (m-, p-, and o-), p-chlorobenzyl, o-bromobenzyl, p-hydroxybenzyl, veratryl, isobutyl, terphthalyl, p-octyloxybenzyl, p-dimethylaminophenyl, t-butyl, etc. Preferred Y moieties are phenyl tolyl, anisyl, and benzyl groups because of their availability. As with group R, the main influence of this group, except with regard to electron induction effects, is on the solubility of the compounds. Preferably Y has 20 or fewer carbon atoms, but up to 30 may be readily tolerated. These compounds are disclosed in a commonly assigned U.S. patent application Ser. No. 237,068, filed in the name of John J. Stofko, Jr. et al. the same day as this application.

The disulfone dyes used in the practice of the present invention are themselves well known in the art for use in light filters, photographic elements, and textiles. These dyes are shown, for example, in U.S. Pat. Nos. 3,933,914 and 4,018,810. These dyes may be generally described by the formula:

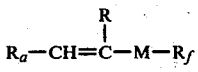

I wherein $R_a$ represents a monovalent chromophoric radical, M represents sulfonyl $\left[ -\overset{\overset{O}{\|}}{\underset{\underset{O}{\|}}{S}}- \right]$, carbonyl $\left[ -\overset{\overset{O}{\|}}{C}- \right]$ or carbonyloxy $\left[ -\overset{\overset{O}{\|}}{C}-O- \right]$, $R_f$ represents a highly fluorinated aliphatic radical, and R represents a monovalent electron-withdrawing radical. These R groups may include such materials as a cyano, arylcarbonyl, alkylcarbonyl, perfuoralkyl, alkylsulfonyl, highly fluorinated alkylsulfonyl, perfluoroalkylsulfonyl, arylsulfonyl nitro, sulfonyl fluoride, or sulfonyl chloride radical. Radicals preferred for R include cyano, highly fluorinated aliphaticsulfonyl, fluoroalkylsulfonyl or highly fluorinated alkylcarbonyloxy (for example having from 1–18 carbon atoms—preferably 1–8 carbon atoms), and arylsulfonyl (preferably phenylsulfonyl). The term highly fluorinated aliphatic radical is defined in the present invention as an aliphatic group having its carbon atoms fluorinated except that with two or more carbon atoms present in the group, the terminal carbon atom may have a hydrogen or chloro substituent, and with four or more carbon atoms the last two carbon atoms may have one or two hydrogen or chlorine substituents.

The preferred chromophoric radicals that are represented by $R_a$ in the general formula are radicals having chemical structures shown in Formulae II–V as follows:

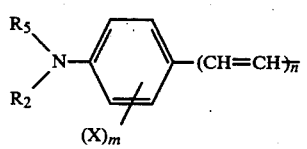

II wherein $R_5$ and $R_2$ are hydrogen, monovalent alkyl of 1 to 20 carbon atoms (preferably methyl or ethyl), cyanoalkyl (preferably cyanomethyl or cyanoethyl), aryl (preferably phenyl), or aralkyl (preferably benzyl); n is the integer 0, 1, or 2, X is halogen (preferably chlorine or bromine), lower alkyl (e.g., having 1–3 carbon atoms), cyano, nitro, lower alkoxy (preferably having 1–3 carbon atoms), hydrogen, hydroxyl, sulfonate, or carboxyl; and m is the integer 1–3;

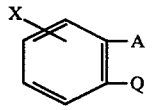

III wherein X is as defined above, A is a trivalent alkenylene radical having from 2–4 carbon atoms, and Q is a divalent nitrogen atom, substituted nitrogen (e.g., with such as a hydrogen, alkyl or aryl (e.g., phenyl)) or a divalent oxygen;

$(R_3O)_bAr—$ IV wherein $R_3$ is an alkyl group having from 1–4 carbon atoms, b is the integer 1–5 and Ar is a naphthylene group having a valency of b+1; and

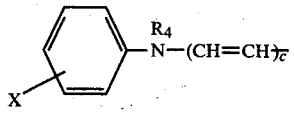

V wherein X is as defined above, c is the integer 1, 2, or 3, and $R_4$ is hydrogen, alkoxy, or a monovalent alkyl group (preferably having from 1–3 carbon atoms).

$R_f$ is preferably a saturated fluoroaliphatic radical, for example containing 1 to 18 carbon atoms (preferably 1 to 8 carbon atoms) with the majority of the carbon atoms most preferably being perfluorinated.

The term "perfluorinated" is employed to denote substitution of all carbon-bonded hydrogen atoms by fluorine atoms, in accord with the recognized usage of the term.

The above mentioned highly fluorinated aliphatic groups are defined as aliphatic groups which can contain chlorine and hydrogen atoms bonded to the carbon atoms (not more than one chlorine or hydrogen for two adjacent carbons) as well as having fluorine atoms bonded to carbon atom. The fluoroaliphatic radical may be a straight or branched chain, cyclic, or a straight chain including a cyclic portion. Additionally, the fluoroaliphatic group may contain an oxygen atom linking two carbon atoms, e.g., $—CF_2OCF_2—$, or a nitrogen atom linking three carbon atoms, e.g., $(R_fCH_2)_2NCF_2—$. Exemplary aliphatic groups include 1,1,1-tris-trifluoroethyl, perfluoromethyl, perfluorobutyl, perfluorooctyl, perfluorododecyl, perfluoroisopropyl, perfluoro-(2-cyclohexylethyl), omega-chloroperfluorohexyl, 2-hydroperfluoropropyl, perfluoro(3-morpholinopropyl), and perfluoro(3-piperidinopropyl).

The preparation of these dyes is clearly described in the above cited U.S. patents.

Various binder materials known in the art are useful with the electronically active donor compounds of the present invention. It is of course preferred that the binder be essentially optically transparent or at least transparent to the wavelengths of radiation to which the compounds (sensitized or not) are sensitive. Amongst the useful binders are poly(vinyl chloride), poly(siloxanes), poly(vinyl butyral), poly(vinyl acetate), styrene/acrylonitrile copolymers, polyacrylates, polymethacrylates, polycarbonates, polyepoxides, polyurethanes, polyamides, polyethers, polyesters, polyolefins as well as block, graft, random, and alternating polymers, copolymers, terpolymers and mixtures thereof and the like. The binders are preferably electrically inactive themselves. The preferred polymeric binders are polycarbonates, polyacrylates, polyesters, and styrene/acrylonitrile copolymers. Coating aids, lubricants, surface active agents, other sensitizing dyes, and other adjuvants may be added to the composition.

For use of the materials of the present invention as electrophotographic layers, the organic electron donor compounds should be present as at least 20 percent by weight of the composition. Preferably the donor compound should be present as at least 25 or 35 percent by weight of the layer, and may comprise up to 100% by weight of the layer, excluding of course the sensitizer dye. The sensitizing dyes should be used in amounts which will increase the sensitivity of the composition.

This is defined as an effective sensitizing amount of dye. Ordinarily amounts of up to 10% by weight dye may be used, but certain constructions can be envisaged with as much as 90% by weight of dye and 10% by weight of organic electron donor compounds. Amounts of dye as small as 0.005 percent by weight can be useful. More preferred concentration ranges are between 0.05 and 5 percent by weight.

The photosensitive materials of the present invention may also be useful as photoconductive toners, photovoltaic devices, organic semiconductors, and the like, and may use concentrations of organic electron donor compounds as low as 5 percent by weight.

It has been surprisingly noted that the benzocarbazole-aldehyde condensation products of the present invention are better charge transport materials than the corresponding benzocarbazoles by themselves. This is surprising because it is the benzocarbazole nucleus which is the electronically active portion of both molecules. Even when benzocarbazoles were used in reasonably higher molecular proportions to the binder than were the condensates, the condensates would still perform better.

These and other aspects of the present invention will be shown in the following examples.

EXAMPLE 1

Synthesis of
bis-5,5'-(N-ethylbenzo[a]carbazolyl)phenylmethane

Into a round bottom flask equipped with a reflux condenser and a mechanical stirrer were added 22.4 grams (0.1 mole) of N-ethylbenzo[a]carbazole and 5.3 grams (0.05 mole) of benzaldehyde. Two hundred milliliters of ethanol acidified with 8 ml of concentrated hydrochloric acid were then added. The mixture was stirred at reflux under a nitrogen atmosphere for sixteen hours. The insoluble, pure white product was isolated by filtration, washed with 100 ml of ethanol, and dried in a vacuum oven. The yield was 95% of the theoretic calculation.

EXAMPLES 2–17

In a manner substantially identical to that of the previous example, electronically active electron donor compounds of the present invention were obtained by condensing N-ethylbenzo[a]carbazole with each of the following aldehydes in equimolar replacement for the benzaldehyde:

2. p-tolualdehyde
3. m-tolualdehyde
4. o-tolualdehyde
5. p-anisaldehyde
6. m-anisaldehyde
7. o-anisaldehyde
8. p-chlorobenzaldehyde
9. p-bromobenzaldehyde
10. o-bromobenzaldehyde
11. p-hydroxybenzaldehyde
12. α-naphthaldehyde
13. veratraldehyde
14. p-octyloxybenzaldehyde
15. iso-butyraldehyde
16. n-nonylaldehyde
17. terphthaldehyde

EXAMPLES 18–21

In a manner substantially identical to that of Example 1, the following combinations of carbazoles and aldehydes were used to synthesize compounds of the present invention.

18. benzo[a]carbazole and benzaldehyde
19. N-ethylbenzo[b]carbazole and benzaldehyde
20. N-ethyldibenzo[a,g]carbazole and benzaldehyde
21. N-ethyl-8-methoxybenzo[a]carbazole and benzaldehyde The addition of any of the compounds produced in Examples 1–21 to electrically inert polymeric binders formed positive charge transport layers. These layers could be formed on photoconductive layers and were capable of supporting injected photogenerated holes from the photoconductive layer and allowed the transport of these holes through the transport layer to selectively discharge the surface charge.

EXAMPLE 22

A bulk sensitized photoreceptor was prepared by coating a solution of 10 percent by weight solids (5.2% of p-dimethylamino-di- -perfluoromethylsulfonylcinnamilidene, 38% bis(N-ethyl-1,2-benzocarbazolyl)phenyl methane, and 56.8% polycarbonate resin at about $1\times10^{-4}$ m onto aluminized polyester(polyethyleneterephthalate). This was air dried for 15 minutes at 85° C. The sample was evaluated for its xerographic response to positive corona charging. The sample displayed a maximum sensitivity at 540 nm. At that wavelength, the construction required approximately 3 Joules/cm$^2$ to discharge the sheet to one half its potential from 740 volts. The sample displayed an initial discharge rate of 736 volts/sec. with 3.27 watts/cm$^2$.

The dye used in this example has the structure

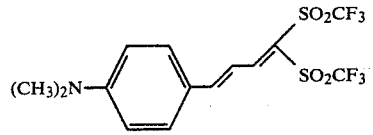

The dyes having the structures

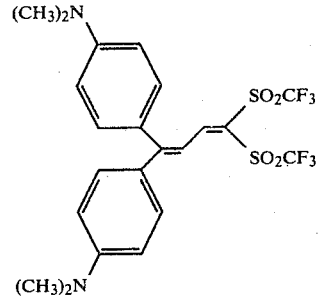

and

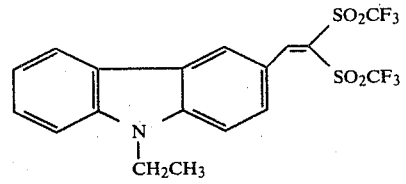

were also found to work well in the construction of this example.

EXAMPLE 23

A coating solution was prepared from 0.6 g polyester (Vitel ® PE-200 organic solvent soluble copolyester of terephthalic acid, isophthalic acid, and ethylene glycol), 0 4 g of the compound of Example 1, and 0.005 g of disulfone dye A in a mixture of 4.5 g dichloromethane and 4.5 g of 1,2-dichloroethane, filtered, then knife coated onto an aluminized polyester substrate. The wet thickness of the coating was $1\times10^{-4}$ m before oven drying for 15 minutes at 80° C. The electrophotographic performance of this coating is shown in Table I.

EXAMPLES 24–32

Coating solutions were prepared of 0.6 g of an organic solvent soluble copolyester derived from terephthalic acid, isophthalic acid and ethylene glycol (Vitel ®PE-200), 0.4 g of the indicated charge transport material, and 0.005 g of the disulfone dye indicated in Table I. These materials were knife coated onto aluminized polyester from a solution with 4.5 g dichloromethane and 4.5 g of 1,2-dichloroethane after filtering. The wet thickness was $1\times10^{-4}$ m before air drying then oven drying for 15 minutes at 80° C. The electrophotographic performance of these coatings is shown in Table I.

EXAMPLE 33

A coating solution of 1.0 g polyvinylcarbazole and 0.005 g disulfone dye D in a mixture of 4.5 g of dichloromethane and 4.5 g of 1,2-dichloroethane was knife coated at $1\times10^{-4}$ m wet thickness onto aluminized polyester. The coating was air dried then oven dried for 15 minutes at 80° C. The electrophotographic behavior of the construction is shown in Table I.

Disulfone Dyes (A)

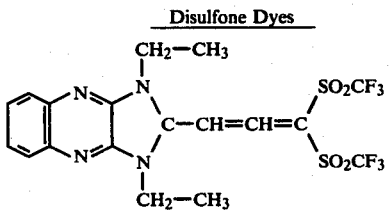

(B)

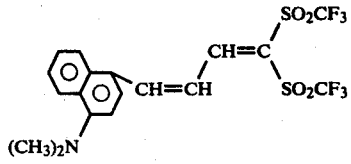

-continued

Disulfone Dyes (C)

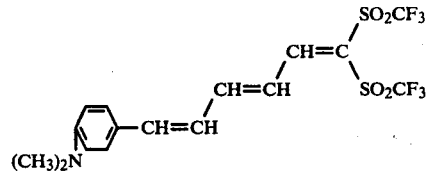

(D)

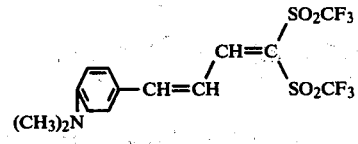

(E)

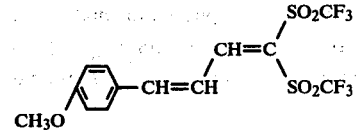

TABLE I

| Example | Dye | Transport Material | Wavelength (nm) | Exposure to Vo/2 (ergs/cm²) |
|---|---|---|---|---|
| 23 | A | bis-5,5'-(N—ethylbenzo[a]carbazolyl)phenylmethane | 440 | 36 |
| 24 | B | bis-5,5'-(N—ethylbenzo[a]carbazolyl)phenylmethane | 600 | 80 |
| 25 | C | bis-5,5'-(N—ethylbenzo[a]carbazolyl)phenylmethane | 660 | 48 |
| 26 | D | bis-5,5'-(N—ethylbenzo[a]carbazolyl)phenylmethane | 560 | 111 |
| 27 | E | bis-5,5'-(N—ethylbenzo[a]carbazolyl)phenylmethane | 460 | 57 |
| 28 | D | 1,5-diphenyl-3-styrylpyrazoline | 560 | 40 |
| 29 | D | 4,4'-bis-(diethylamino)-2',2''-dimethyltriphenyl methane | 560 | — |
| 30 | D | N,N,N',N'—tetrabenzyl-m-phenylenediamine | 560 | 570 |
| 31 | D | 2,5-bis-(p-diethylaminophenyl)-1,3,4-oxadiazole | 560 | 70 |
| 32 | D | p-diethylaminobenzaldehyde-diphenylhydrazone | 560 | 123 |
| 33 | D | polyvinylcarbazole | 560 | 38 |

We claim:

1. A spectrally sensitized organic charge transport material comprising an electronically active organic donor compound sensitized with a dye of the formula

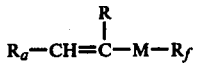

Wherein $R_a$ represents a monovalent chromophoric radical, M represents

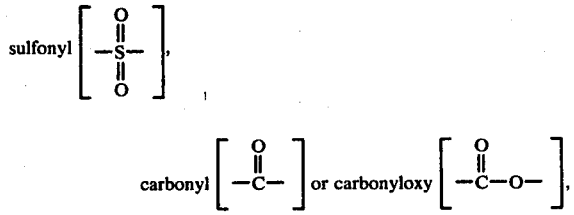

$R_f$ represents a highly fluorinated aliphatic radical and R represents a monovalent electron-withdrawing radical.

2. A spectrally sensitized organic charge transport material comprising an electronically active organic donor compound having the formula

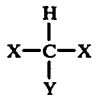

where X is

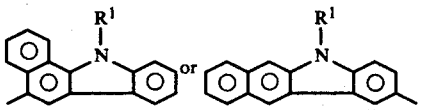

wherein $R^1$ and Y are independently selected from the group consisting of aliphatic, aromatic, heterocyclic, and mixed aliphatic-aromatic groups and a sensitizing amount of a disulfone dye having the formula:

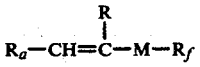

wherein $R_a$ represents a monovalent chromophoric radical, M represents

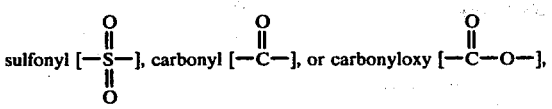

$R_f$ represents a highly fluorinated aliphatic radical, and R represents a monovalent electron-withdrawing radical.

3. The material of claim 2 wherein Y is an aromatic group.

4. The material of claim 2 wherein R is an n-alkyl group of from 1 to 20 carbon atoms.

5. The material of claim 2 wherein Y is an aromatic group, $R^1$ is selected from the class consisting of an n-alkyl group of 2 to 20 carbon atoms, phenyl group, naphthyl group, or benzyl group, R is a highly fluorinated alkylsulfonyl group, $R_f$ is a highly fluorinated aliphatic group, and M is sulfonyl.

6. The material of claim 2 wherein Y is phenyl and $R^1$ is n-alkyl of 2 to 20 carbon atoms.

7. A photoconductive layer comprising a polymeric binder and at least 20 percent by weight of the spectrally sensitized material of claim 1.

8. A photoconductive layer comprising a polymeric binder and the spectrally sensitized material of claim 2.

9. A photoconductive layer comprising a polymeric binder and the spectrally sensitized compound of claim 5.

10. The layer of claim 8 wherein Y is an aromatic group.

11. The layer of claim 8, 9 or 10 wherein $R^1$ is an alkyl group of 2 to 20 carbon atoms, phenyl group, naphthyl group or benzyl group, and M is sulfonyl.

12. The layer of claim 8 wherein Y is phenyl and $R^1$ is n-alkyl of 2 to 20 carbon atoms.

13. A electrophotographic element comprising, in sequence, a conductive layer, a charge generating layer, and the photoconductive insulating layer of claims 8, 9 or 10.

14. A electrophotographic element comprising, in sequence, a conductive layer and the photoconductive insulating layer of claim 8, 9, or 10.

15. The layer of claim 6, 7, 8 or 10 wherein M is sulfonyl.

* * * * *